US009806473B2

(12) United States Patent
Kim

(10) Patent No.: US 9,806,473 B2
(45) Date of Patent: Oct. 31, 2017

(54) HIGH FREQUENCY MINIATURE CONNECTORS WITH CANTED COIL SPRINGS AND RELATED METHODS

(71) Applicant: Bal Seal Engineering, Inc., Foothill Ranch, CA (US)

(72) Inventor: Jin Kim, Foothill Ranch, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 0 days.

(21) Appl. No.: 14/988,583

(22) Filed: Jan. 5, 2016

(65) Prior Publication Data

US 2016/0204557 A1 Jul. 14, 2016

Related U.S. Application Data

(60) Provisional application No. 62/101,241, filed on Jan. 8, 2015.

(51) Int. Cl.

| | |
|---|---|
| ***H01R 24/40*** | (2011.01) |
| ***H01R 13/627*** | (2006.01) |
| ***H01R 43/16*** | (2006.01) |
| *H01R 107/00* | (2006.01) |
| *H01R 13/187* | (2006.01) |

(52) U.S. Cl.

CPC ..... *H01R 24/40* (2013.01); *H01R 13/6277* (2013.01); *H01R 43/16* (2013.01); *H01R 13/187* (2013.01); *H01R 2107/00* (2013.01)

(58) Field of Classification Search

CPC ..... H01R 24/40; H01R 43/16; H01R 13/187; H01R 2107/00; H01R 4/4863; H01R 13/6277

USPC ..... 439/578, 349, 840, 841

See application file for complete search history.

(56) References Cited

U.S. PATENT DOCUMENTS

| | | | | | |
|---|---|---|---|---|---|
| 2,761,111 | A * | 8/1956 | Klostermann | H01R 13/633 | 439/271 |
| 3,793,610 | A * | 2/1974 | Brishka | H01R 13/6277 | 439/349 |
| 4,678,210 | A | 7/1987 | Balsells | | |
| 5,195,904 | A * | 3/1993 | Cyvoct | H01R 13/6277 | 439/349 |
| 5,411,348 | A | 5/1995 | Balsells | | |
| 5,545,842 | A | 8/1996 | Balsells | | |
| 5,938,465 | A * | 8/1999 | Fox, Sr. | H01R 13/627 | 439/350 |

(Continued)

*Primary Examiner* — Tulsidas C Patel
*Assistant Examiner* — Travis Chambers
(74) *Attorney, Agent, or Firm* — Klein, O'Neill & Singh, LLP

(57) ABSTRACT

Coaxial connecting devices used for transmitting high frequency electrical signals having two connector elements of generally cylindrical profile, and wherein each of the connector elements has an inner conductor, an insulator, and an outer conductor. In one of the two connector elements that may be of a male or a female orientation has two canted coil spring contacts where at least one of a first spring contact can be retained within at least one first spring groove within a second inner conductor and at least one of a second spring contact is retained within at least one second spring groove within a second outer conductor. The at least one second spring contact can be used as a simultaneous EMI shielding contact and latching, locking, or both latching and locking device.

19 Claims, 3 Drawing Sheets

(56) References Cited

U.S. PATENT DOCUMENTS

| | | | | |
|---|---|---|---|---|
| 6,835,084 | B2 | 12/2004 | Poon et al. | |
| 7,538,289 | B2 | 5/2009 | Carroll | |
| 7,722,415 | B2 | 5/2010 | Changsrivong | |
| 7,914,351 | B2 | 3/2011 | Balsells et al. | |
| 7,955,145 | B2 * | 6/2011 | Chansrivong | H01R 13/15 439/788 |
| 8,052,459 | B2 | 11/2011 | Smith et al. | |
| 8,096,842 | B2 | 1/2012 | Poon et al. | |
| 8,308,167 | B2 | 11/2012 | Balsells et al. | |
| 8,382,532 | B2 | 2/2013 | Sjostedt et al. | |
| 8,491,346 | B2 | 7/2013 | Sjostedt et al. | |
| 8,496,494 | B2 * | 7/2013 | Jordan | H01R 9/032 439/349 |
| 8,561,274 | B2 | 10/2013 | Balsells | |
| 9,004,805 | B2 | 4/2015 | Changsrivong et al. | |
| 9,267,526 | B2 | 2/2016 | Balsells | |
| 9,284,970 | B2 | 3/2016 | Dilmaghanian et al. | |
| 9,312,630 | B2 | 4/2016 | Huang | |
| 9,407,029 | B2 * | 8/2016 | Jordan | H01R 13/514 |
| 9,500,211 | B2 | 11/2016 | Changsrivong | |
| 9,534,625 | B2 | 1/2017 | Balsells | |
| 2002/0122690 | A1 | 9/2002 | Poon et al. | |
| 2013/0149029 | A1 * | 6/2013 | Changsrivong | F16B 17/00 403/361 |
| 2013/0149031 | A1 | 6/2013 | Changsrivong et al. | |

* cited by examiner

HIGH FREQUENCY MINIATURE CONNECTORS WITH CANTED COIL SPRINGS AND RELATED METHODS

FIELD OF ART

The present invention is generally directed to connectors with specific discussions on miniature coaxial connectors used for transmitting high frequency electrical signals.

BACKGROUND

High frequency miniature coaxial connectors are typically used for transmitting and delivering high frequency signals, typically in the range of 3 MHz to 300 GHz, from one medium to another. One example of such connectors, and also one of the most widely used in the industry, is known as the N connector.

There are many different types of high frequency miniature coaxial connectors used today that are available in different sizes and configurations with various limitations on maximum frequency transmission. Usually, the smaller the diameter of the connector, the higher the frequency signals that the connector is able to deliver successfully to the receiving medium. Some of the known connectors with notably small diameters are miniature coaxial connectors within the sub-miniature category known as SMA, SMB, and SMC. Among these, two of the most commonly used high frequency connectors are the SMA and the SMB wherein the former uses a threaded coupling means while the latter uses a snap-on coupling means. The snap-on coupling mechanism of the SMB connector is usually established with a metal collet within a first connector element engaging in a groove of a second connector element.

One of the primary aspects in determining the quality of a miniature coaxial connector is its working frequency range, more specifically how wide the frequency range can be so that it can be suitable for numerous applications. Generally, the working frequency range depends on a combination of factors such as the characteristic impedance, the Voltage Standing Wave Ratio (VSWR), and the connector cut-off frequency. These factors are significantly dependent on the internal structure and geometry of the connector where a mismatch or any sort of discontinuity may affect signal quality, especially in the higher frequency ranges.

Typical working frequency range of an SMB connector is up to 4 GHz while that of an SMA connector may be up to 26 GHz. Such lower working frequency range of the SMB connector as compared to that of the SMA connector may be due to shorter wavelength electromagnetic (EM) waves in the higher frequency range that can easily leak through the slots of the metal collet of the SMB connector or inciting unwanted modes of EM waves that inhibit proper signal propagation at those slots. In other words, the slots of an SMB connector may cause mismatches and other discontinuities in the internal structure. In contrast, the threaded coupling mechanism of the SMA connector minimizes the presence of little gaps and seams, and thus the structural mismatches and discontinuities at the junction where the two connector elements mate.

The choice of using an SMA connector or an SMB connector depends on the application. If the application requires more of the quick and easy connection method over signal propagation in the higher frequency, then the SMB connector type would be chosen over the SMA connector type. If the connector needs signal propagation in the higher frequency and does not have to undergo numerous cycles of engagement/disengagement, the SMA would typically be chosen over the SMB connector.

SUMMARY

Aspects of the present invention include miniature canted coil spring contacts sized and shaped for use with high frequency (HF) miniature connectors to establish simultaneous electromagnetic interference (EMI) shielding and engagement means and therefore overcoming at least some of the major limitations faced by both the SMA and SMB connectors. First, the use of miniature canted coil spring contacts for EMI shielding improves the continuity of the characteristic impedance of the connector throughout as compared to that of the SMB connector by minimizing structural mismatches and discontinuities. This feature is possible at least in part because a canted coil spring contact with certain structural features requires only a small groove within a first outer conductor of a first connector element (male or female) for it to be retained and can quickly establish engagement with a second outer conductor of a second connector element (male or female).

The easy engagement by a canted coil spring contact with solid body metal outer conductors can be incorporated with quick lock, slip-on or more complicated engagements and therefore easy to apply. The cant coil spring contact minimizes unwanted EM wave leakage (or radio frequency (RF) leakage) and incitation of unwanted EM wave modes that may significantly deter the overall performance of the connecting apparatus. The result of improved continuous characteristic impedance also improves the voltage standing wave ratio (VSWR) throughout the connecting apparatus in which the ratio does not exceed the value of 2.5 while signal is propagating below the inherent cut-off frequency of the connecting apparatus. The overall consequence of improved continuity in the internal structure and geometry by using a miniature canted coil spring contact for simultaneous EMI shielding and engagement means can establish an overall higher operating frequency range than the SMB connector as well as establish easy engagement/disengagement mechanism than the SMA connectors.

The miniature canted coil spring contact's dual function of EMI shielding and engagement utility also allows the connecting apparatus to be more compact in size as it does not require an extra component to accomplish each feature separately but can optionally be incorporated. For example, the SMB connector requires an extra outer metal body that encompasses the metal collet, which increases the overall diameter of the connector. The use of a miniature canted coil spring contact can simply establish a reliable connection without any extra component.

Not only size in terms of diameter but also in terms of length can be greatly reduced when employing features disclosed herein. Generally, a collet requires a relatively long length for it to engage and disengage properly, which may significantly limit how small a connecting apparatus can be made. However, the mentioned method of using a miniature canted coil spring contact can eliminate such length requirement since a canted coil spring contact does not require a relatively long length to achieve engagement/disengagement mechanisms. Such method of use of a miniature canted coil spring contact may reduce the overall length of the connecting apparatus down to a size of one or more typical coin cell battery, as an example.

A further aspect of the present disclosure is a high frequency connecting apparatus. The apparatus can comprise: two coupled connector elements of generally cylindrical profile, each having a inner conductor, an insulating layer, and an outer conductor in a coaxial structure; a first said connector element a first said inner conductor and a first said outer conductor separated radially by a first said insulating layer and fitted radially in between the first said inner conductor and the first said outer conductor, wherein the first said inner conductor and the first said outer conductor may be of male orientations; a second said connector element comprising a second said inner conductor and a second said outer conductor separated radially by a second said insulating layer and fitted radially in between the second said inner conductor and the second said outer conductor, wherein the second said inner conductor and the second said outer conductor may be of female orientations; the second said inner conductor and the second said outer conductor comprising at least one first spring groove and at least one second spring groove, respectively; and the at least one first spring groove and the at least one second spring groove comprising at least one canted coil spring contact wherein the at least one canted coil spring contact located within the at least one second spring groove acts as simultaneous EMI shielding and engagement means.

The high frequency connecting apparatus wherein the at least one canted coil spring contact can be located within the at least one first spring groove acting as simultaneous electrical signal propagation and engagement means.

The high frequency connecting apparatus wherein the at least one canted coil spring contact can simultaneously establish engagement and electrical signal propagation between two said connector elements through canted coil spring holding, latching, and/or locking.

The high frequency connecting apparatus wherein at least one canted coil spring contact can simultaneously establish engagement and EMI shielding between two said connector elements through canted coil spring holding, latching, and/or locking.

The high frequency connecting apparatus wherein the at least one canted coil spring contact can have a configuration with alternating coils with different dimensions.

The high frequency connecting apparatus wherein the at least one canted coil spring contact can be radially retained within at least one metal spring handling ring.

The high frequency connecting apparatus wherein the at least one metal handling ring can be made from a copper alloy.

The high frequency connecting apparatus wherein the at least one first spring groove can be formed by a two-part assembly comprising the at least one metal handling ring and the second inner conductor.

The high frequency connecting apparatus wherein the at least one second spring groove can be formed by a two-part assembly comprising the at least one metal handling ring and the second outer conductor.

A further aspect of the present disclosure is a high frequency connecting apparatus comprising: a first connector element comprising an inner conductor, an outer conductor and an insulator separating the inner conductor from the outer conductor; said insulator fitted radially in between the inner conductor and the outer conductor, wherein said inner conductor comprises a male tip; a second connector element comprising an inner conductor, an outer conductor, and an insulator separating the inner conductor from the outer conductor, said insulator fitted radially in between the inner conductor and the outer conductor, wherein the inner conductor comprises a female tip comprising a bore for receiving the male tip; a groove on the outer conductor of the first connector element and a groove on the outer conductor of the second connector element capturing a canted coil spring contact therebetween to provide simultaneous EMI shielding and engagement structure to engage the first connector element to the second connector element.

The canted coil spring contact can be mounted to the groove of the outer conductor of the second connector element prior to engaging the first connector element to the second connector element. The canted coil spring can instead be mounted to the first connector element prior to engaging the two connector elements.

The engagement with the canted coil spring contact can be a latching connection, a locking connection, or a holding connection. The canted coil spring can have a plurality of interconnected coils of the same dimension or with different dimensions and wherein not all of the coils occupy the inside diameter.

When two canted coil springs are used with a first connector element or a second connector element, the two springs can have the same size or different sizes. The two canted coil springs can be standard canted coil springs in which the plurality of coils of each canted coil spring can have generally the same dimension or can have two or more different coil dimensions. The two canted coil spring can include one standard canted coil spring and a different canted coil spring with two or more different coil dimensions. The outer canted coil spring for use with an outer conductor can embody a standard canted coil spring while the inner canted coil spring used with an inner conductor can have a plurality of coils with two or more different coil dimensions and wherein not all of the coils occupy the inside diameter.

The inner conductors of the first and second connector elements can be made from the same conductive material or different conductive materials.

The outer conductors of the first and second connector elements can be made from the same conductive material or different conductive materials.

The female tip can comprise a slotted socket or a groove with a canted coil spring contact.

The outer conductor can comprise a base and an annular side and wherein the annular side can have at least two different side sections of different dimensions or thicknesses. One of the side sections can include a groove for capturing a canted coil spring. The base can incorporate an opening for accommodating the inner conductor.

The canted coil spring contact can have a plurality of coils with alternating coils with different dimensions. The alternating coils can have different patterns, such as two large coils then one small coil or two smaller coils then one large coil. The alternating coils can be one to one of small coil to big coil. By small and big, the terms are understood to mean relative sizes or dimensions.

The canted coil spring contact can be retained within at least one metal spring handling ring. The metal spring handling ring can have an L-shape cross-section.

The metal handling ring can be made from a copper alloy. Other conductive materials are contemplated, such as multi-metallic materials.

The male tip of the inner conductor can include a groove for capturing part of a canted coil spring.

The male tip can comprise a tapered end and the inner conductor can comprise a flange. The flange can comprise stepped surfaces. The insulator can comprise a bore with stepped surfaces to mate with the stepped surfaces of the flange.

The two connector elements can be used as a PCB connector. Each connector element can be referred to as a coaxial connector wherein each comprises an inner conductor and an outer conductor, coaxially positioned relative to one another. At least one canted coil spring can be incorporated and captured between two grooves to engage the first connector element to the second connector element. The two grooves can be located on the outer conductor of each of the two connector elements.

A further aspect of the present disclosure is a method of manufacturing a high frequency connecting apparatus. The method can comprise: forming a first connector element, said first connector element comprising an inner conductor, an outer conductor and an insulator separating the inner conductor from the outer conductor; said insulator fitted radially in between the inner conductor and the outer conductor, wherein said inner conductor comprises a male tip; forming a second connector element, said second connector element comprising an inner conductor, an outer conductor, and an insulator separating the inner conductor from the outer conductor, said insulator fitted radially in between the inner conductor and the outer conductor, wherein the inner conductor comprises a female tip comprising a bore for receiving the male tip; forming a groove on the outer conductor of the first connector element and a groove on the outer conductor of the second connector element; and placing a canted coil spring contact in one of the two grooves to provide simultaneous EMI shielding and engagement structure to engage the first connector element to the second connector element when engaging the two connector elements.

The method wherein the canted coil spring contact can be mounted to the groove of the outer conductor of the second connector element prior to engaging the first connector element to the second connector element.

The method can further include engaging the first connector element to the second connector element and wherein the engagement is a latching connection or a locking connection. The engagement can alternatively be a holding connection.

The method wherein the female tip can comprise a slotted socket or a groove with a canted coil spring contact.

The method wherein the canted coil spring contact can have a plurality of coils alternating coils with different dimensions.

The method wherein the canted coil spring contact can be retained within at least one metal spring handling ring.

SMA and SMB connectors are used to emphasize the advantages of the present connector application but application is not limited to only SMA or SMB nor connectors of sub-miniature category and can apply to numerous other miniature connector types.

BRIEF DESCRIPTION OF THE DRAWINGS

These and other features and advantages of the present devices, systems, and methods will become appreciated as the same becomes better understood with reference to the specification, claims and appended drawings wherein:

DETAILED DESCRIPTION

The detailed description set forth below in connection with the appended drawings is intended as a description of the presently preferred embodiments of connectors provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
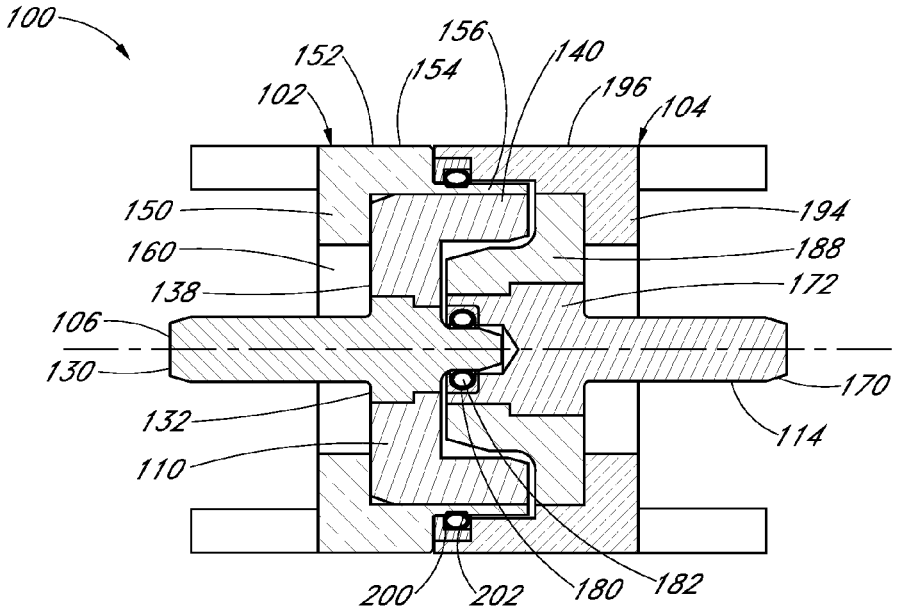
FIG. 1 shows a connecting apparatus, such as a connector, comprising two connector elements that are engaged.
Figure 2:
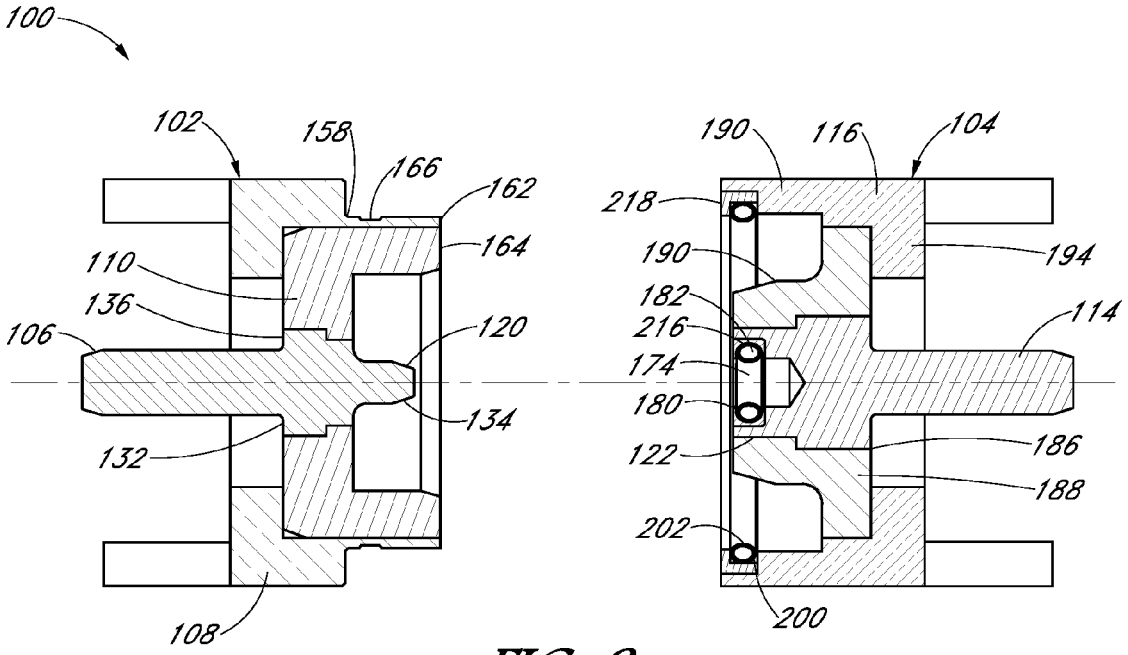
FIG. 2 shows a connecting apparatus, such as a connector, comprising two connector elements that are disengaged.

With reference now to FIG. 1, a cross-sectional side view of a high frequency connecting apparatus or connector 100 comprising two engaged connector elements 102, 104 is shown. The connector 100 and the connector elements 102, 104 have generally cylindrical profile and are shown herein in two-dimensional cross-section. The connector 100 can be provided with the two connector elements 102, 104 not engaged, as shown in FIG. 2. The two connector elements 102, 104 can be made to engage and disengage, as shown in FIGS. 1 and 2, respectively. The connector 100 may be used as PCB to PCB connector, such as for printed circuit board connectors. The connector 100 may alternatively be used for other electronic devices that connect through a coaxial connection, such as computer or audio electronics.

The first connector element 102 can comprise a coaxial structure wherein an inner conductor 106 and an outer conductor 108 are coaxially disposed and an insulator 110 is provided separating the inner and outer conductors 106, 108. As the terms implied, the inner and outer conductors 106, 108 are made from a conductive material while the insulator is made from a non-conducting or an insulating material.

Like the first connector element 102, the second connector element 104 can comprise a coaxial structure wherein an inner conductor 114 and an outer conductor 116 are coaxially disposed and an insulator 118 is provided separating the inner and outer conductors 114, 116. In a specific example, the inner conductor 106 of the first connector element 102 can embody a male connector tip 120 and the inner conductor 114 of the second connector element 104 can embody a female connector tip 122 for receiving the male connector tip 120, as shown in FIG. 1. The connection between the male tip 120 and the female tip 122 can be a direct contact with the surface of the male tip contacting the surface of the female tip or the two can contact via an intermediate contact element, such as a conductive spring.

In an example, the outer conductors 108, 116 of the first and second connector elements 102, 104 can comprise one male outer conductor and one female outer connector for receiving the male outer conductor. As shown, the outer conductor 108 of the first connector element 102 embodies a male structure and the outer conductor 116 of the second connector element 104 embodies a female structure for receiving the male structure, as shown in FIG. 1. In other examples, the male and female outer conductor structures can reverse so that the female outer structure is formed with the first connector element 102 and the male outer structure is formed with the second connector element 104. The male and female inner conductors 106, 114 can also reverse. The connecting apparatus 100 may consist of a 50Ω impedance or a 75Ω impedance. In other examples, the impedance value can vary, such as being larger than 75Ω, smaller than 50Ω, or has a value of between 50Ω and 75Ω. The connecting apparatus 100 is not limited to a PCB to PCB connector and can also be an in-line connector (not shown) as the lengthwise axes of the two inner conductors 106, 114 are aligned or in-line.

FIG. 2 is a cross-sectional side view showing each of the two connector elements 102, 104 in a detailed view, and disengaged from one another. As shown, the first connector element 102 comprises a first inner conductor 106 with a male tip 120. The inner conductor 106 can comprise a metal pin 130 that may be considered as small in diameter, such as in the order of or smaller than 0.020" in diameter. In other examples, the metal pin can have a different diameter, such as larger than 20 mils. The inner conductor 106 can be coupled to or connected to a lead (not shown) and to a printed circuit board. A flange 132 extends radially of the lengthwise axis of the metal pin 130 and the male tip 120 extends from the flange 132. The male tip 120 can include a taped end 134 and a diameter that is the same or smaller than the diameter of the metal pin 130. In some examples, the male tip can be plated with a second metallic layer, platinum, platinum-iridium over copper alloy or over stainless steel.

In an example, the flange 132 of the inner conductor can comprise stepped surfaces for engaging the insulator 110, which can comprise a bore 136 having corresponding structures for receiving the flange 132. The insulator 110 of the first connector element 102 can comprise a base 138 and an annular side 140 defining a receiving space 142 for receiving the insulator 118 and inner conductor 114 of the second conductor element 104, as further discussed below.

The outer conductor 108 of the first connector element 102 can comprise a base 150 and an annular side 152 for receiving the insulator 110. The annular side 152 can extend on either side of the base 150. The insulator 110 can contact the outer conductor 108 or be pressed fit with the outer conductor so that their surfaces contact and be restrained one within the other. The annular side 152 of the outer conductor can include a first side section 154 having an outside diameter and a second side section 156 having an outside diameter that is smaller in size than the diameter of the first side section 154. A shoulder 158 is defined by the different sizes of the two side sections 154, 156.

The base 150 can include an opening 160 for accommodating the inner conductor 106, which projects through the opening 160. The base 150 and the annular side 152 can define a receiving space for receiving the insulator 110. The end surfaces 162, 164 of the two annular sides 140, 152 can terminate along a same plane as shown or on different planes. Tapered surfaces can be incorporated at the ends of the annular sides to facilitate connection. The smaller outside diameter of the second side section 156 is sized and shaped to project into the outer conductor 116 of the second connector element 104, as further discussed below. The components of the first connector element 102 may be assembled by press-fitting, snap-fitting, or other known assembling methods. The diameter of the first insulator 110 and the thickness of the base 138 and/or the annular side 140 can be determined by the set characteristic impedance of the entire connecting apparatus.

A groove 166 is provided on the outside surface of the second side section 156 of the outer conductor 108. The groove 166 can be recessed from the nominal outside diameter of the second side section 156. The groove 166 can have a variety of groove shapes, including a bottom wall located between two sidewalls, can have a V-shape, the V-shape groove can have a flat surface between the two slanted surfaces, the two sidewalls can be generally parallel or angled to one another, can have a C-shape, and/or the bottom wall between two sidewalls can be flat or tapered. The groove 166 can be sized and shaped to receive part of a canted coil spring having a plurality of interconnected canted coils that extend out from the second connector element 104, as shown in FIG. 1. Each coil of the plurality of canted coils can have a major axis and a minor axis, which is smaller than the major axis, and the canted coil spring can be a radial canted coil spring or an axial canted coil spring. The groove 166 can receive the canted coil spring in a latching connection. The canted coil spring is typically compressed when the two connector elements engage by two opposed surfaces. A person of ordinary skill in the art will understand that this groove 166 may embody a shape that can latch and permit disconnection or lock and not permit disconnection. Optionally, the groove is omitted and the surface where the groove 166 is shown is generally flat for a holding application.

FIG. 2 shows the second connector element 104 with a second inner conductor 114 having a conductive metal pin 170 having a diameter that may be considered small, such as in the order of or smaller than 0.020" in diameter. In other examples, the diameter of the metal pin 170 can be different, such as being larger than 20 mils. A flange 172 can extend radially of the lengthwise axis of the metal pin 170 and the female tip 122 can extend from the flange 172. The female tip 122 can comprise a bore 174 for receiving the male tip 120 of the first connector element 102. The inside dimension of the bore 174 can be larger than the male tip 122 so that there is no contact between the male tip 120 and the female tip 122. Optionally, some contact between the male tip 120 and the surfaces of the bore of the female tip 122 can be permitted. The female tip 122 can include a groove 180, also referred to as a spring groove, for holding a canted coil spring 182. When used, the canted coil spring 182 can be made from a conductive metal material or from a multi-metallic wire. The female tip 122 can be considered a housing for holding the canted coil spring and the canted coil spring can be considered as housing mounted. When a canted coil spring is incorporated, the male tip 120 and the female tip 122 can conduct via the canted coil spring.

The groove 180 of the female tip 122 can comprise a recess from the surfaces of the bore 174. The groove 180 can have a variety of groove shapes, including a bottom wall located between two sidewalls, can have a V-shape, the V-shape groove can have a flat surface between the two slanted surfaces, the two sidewalls can be generally parallel or angled to one another, can have a C-shape, and/or the bottom wall between two sidewalls can be flat or tapered. The groove 180 is sufficiently deep so that less than half of the minor axis of the canted coil spring 182 extends out of the groove 180 to be captured by the groove 166 of the outer conductor 108 of the first connector element 102. The groove 180 can be sufficiently wide so that the major axis of the canted coil spring 182 does not touch the two sidewalls or can be sized so that there is some touching. The groove 180 can be formed as a one-piece or can include a separate ring that forms one of the sidewalls. The separate ring can also form part of or all of the groove bottom wall.

The inner conductor 114 of the second connector element 104 projects through a bore 186 of the insulator 118. The bore 186 can have a structure that mates with the flange on the inner conductor 114 and the female tip 122. The bore 186 is provided through a base 188 and is bounded by an annular side 190 of the insulator 118. The annular side 190 has an exterior surface having an outside dimension and a taper. The outside dimension of the insulator 118 is sized so that there is no contact with the insulator 110 of the first connector element 102 when the first and second connector elements engage, as shown in FIG. 1. Alternatively, some touching between the two insulators 110, 118 can be included. The relative positions of the two insulators 110, 118 can be controlled by delimiting relative movements between the two outer conductors 108, 116 and the contact at the male tip 120 and female tip 122.

The outer conductor 116 of the second connector element 104 is shown with a base 194 and an annular side 196. The annular side 196 can extend on either side of the base 194. The base 188 of the insulator 118 is held between the base 194 and the annular side 196 of the outer conductor 116. The base 194 has a bore for accommodating the inner conductor 114, which has a pin 170 that extends though the base.

A groove 200, also referred to as a spring groove, is provided with the interior of the annular side 190 of the outer conductor 116. The groove 200 of the outer conductor 116 can comprise a recess from the surfaces of the bore. The groove 200 can have a variety of groove shapes, including a bottom wall located between two sidewalls, can have a V-shape, the V-shape groove can have a flat surface between the two slanted surfaces, the two sidewalls can be generally parallel or angled to one another, can have a C-shape, and/or the bottom wall between two sidewalls can be flat or tapered. The groove 200 can be formed as a one-piece or can include a separate ring that forms one of the sidewalls. The separate ring can also form part of or all of the groove bottom wall. The components of the second connector element 104 may be assembled in a similar fashion, such as by press-fitting, snap-fitting, or other known assembling methods.

A canted coil spring 202 is positioned in the spring groove 200 of the outer conductor 116. The canted coil spring 202 can comprise a plurality of interconnected coils that cant generally along the same direction. Each coil can have a major axis and a minor axis and the spring can be a radial canted coil spring or an axial canted coil spring made form a metal conductive material. The spring can also be made from a multi-metallic wire and the wire can be round or non-round, such as being oval, square, or other shapes. The canted coil spring 202 is configured for electrical signal propagation. In some examples, the inner and outer conductors may have more than one spring grooves for accommodating more than one canted coil springs. In still other examples, the canted coil spring may be mounted to the groove 166 of the outer conductor 108 of the first connector element 102 and the groove 200 of outer conductor 116 is sized to capture the part of the spring that extends out the groove 166. In still yet other examples, the groove 200 of the outer conductor 116 is sized and shaped to house other types of electrical spring contacts that can conduct electricity, such as a V-spring.

With reference again to FIG. 1, when the first connector element 102, which can be referred to as the male connector element, is engaged to the second connector element 104, which can be referred to as the female connector element, the two outer conductors 108, 116 latch and permits disconnector or lock and not permit disconnection, depending on the desired application. The type of engagement and whether the two connector elements can disconnect can be dependent on the shape of the grooves 166, 200, the type of spring, and the position the spring seats within the common groove defined by the two grooves 166, 200. The latching can be controlled to require a certain amount of disconnect force needed before the two structures can separate. Below the required disconnect force, the two connector elements can be designed to not separate. If the two grooves 166, 200 are designed to lock, no amount of force can separate the two connector elements unless the applied force destroys the canted coil spring 202 and renders it non-reusable.

Internally, the male tip 120 projects into the female tip 122 and the connection is known as a holding connection, which utilizes the canting force of the canted coil spring 182 pressing against the surface of the male tip 120. Current or electricity can conduct between the two inner conductors 106, 114 and the inner canted coil spring 182 and between the two outer conductors 108, 116 and the outer canted coil spring 202. Optionally, an insulating outer jacket can be provided to the outside of the first connector element 102, the second connector element 104, or both.

Figure 5:
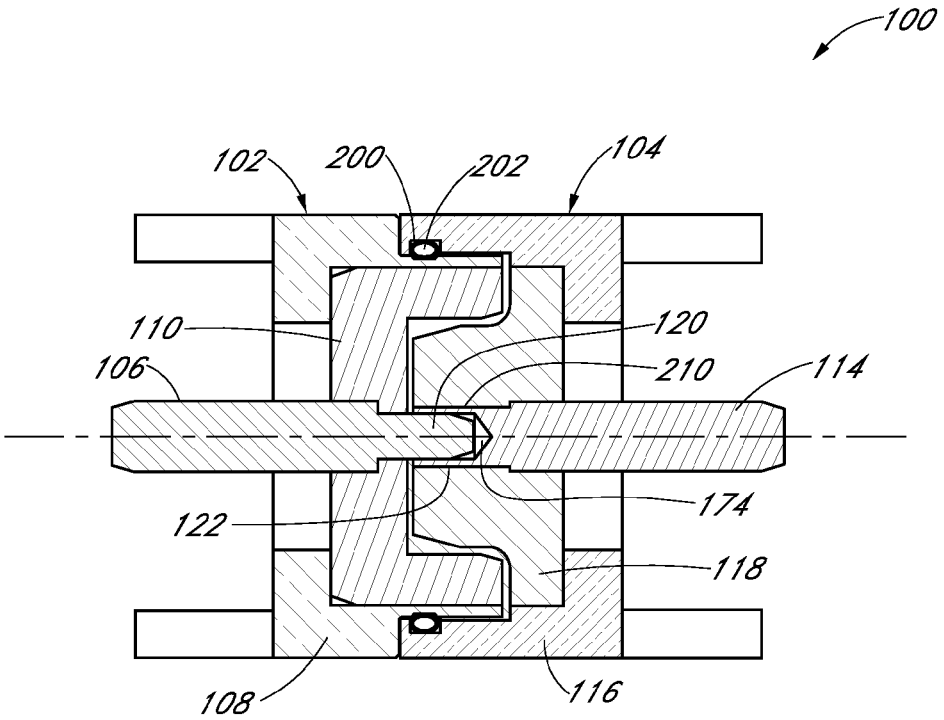
FIG. 5 shows another alternative connecting apparatus, such as a connector, comprising two connector elements wherein a canted coil spring is used for the simultaneous EMI shielding and engagement means.

FIG. 5 shows a high frequency connecting apparatus or connector 100 provided in accordance with alternative aspects of the present disclosure. The present alternative connector 100 is similar to the connector 100 of FIGS. 1 and 2 and comprises a first connector element 102 and a second connector element 104, shown engaged to one another. In the present embodiment, the inner conductor 106 has a male tip 120 engaged to a female tip 122 of the inner conductor 114 of the second connector element 104 having a slotted socket contact 210 instead of a socket with a canted coil spring contact located in a spring groove. The slotted socket contact 210 of the female tip 122 can embody a bore 174 sized and shaped to receive the male tip 120 and abut, contact, or squeeze the male tip 120 and wherein the female tip 122 has a slot or a slit formed in or through the wall surfaces of the female tip to enable the socket to deflect or spread to receive the male tip.

The outer conductor 116 of the present embodiment comprises a spring groove 200 that houses a canted coil spring contact 202 for simultaneous EMI shielding and connection means, to connect the first connector element 102 and the second connector element 104. As shown, the spring groove 200 houses the canted coil spring contact 202 to achieve simultaneous EMI shielding and engagement/disengagement mechanisms. As mentioned previously, engagement/disengagement mechanisms may comprise latching, locking, or both.

With reference again to FIGS. 1 and 2, by utilizing a canted coil spring contact 202 with the outer conductor 116 of a coaxial connector structure, the connector 100 is capable of quick and easy connection means of two solid metal bodies with simultaneous EMI shielding without complicated parts, such as a separate collet. The use of the canted coil spring contact 202 with an outside conductor 116 for engaging a second outside conductor, the connector 100 of the present disclosure can have improved continuity characteristic impedance of the entire connecting apparatus. Two solid body metals, such as the outer conductor 108 of the first connector element 102 and the outer conductor 116 of the second connector element, may attribute less discontinuities and mismatches in geometry since they are of the form that minimizes gaps and seams in structural configuration. An improvement in the continuity of the impedance can result in optimal signal propagation with minimal signal losses.

The quick engagement/disengagement mechanism provided by utilizing a canted coil spring in a spring groove of an outer conductor for engaging a groove of another outer conductor can decrease the length of the male connector element 102 since it does not require the typical lengthy collet to perform the connection function. In other words, using a canted coil spring in a spring groove of a coaxial connector structure can be implemented in a connector having an overall length that is shorter than ones that uses a collet with everything else being equal. The overall length of the entire connecting apparatus, with both male and female connector elements, can possibly be reduced down to a length of a single one coin cell battery. Not only the length of the connector assembly can be reduced but also the overall diameter may be decreased, which may open up different applications for miniature coaxial connectors that the currently existing high frequency connectors cannot or unable to perform. Of course, the size mentioned is exemplary only and can vary, such as made larger or smaller.

In an example, the inner spring groove 180 and the outer spring groove 200 shown in FIG. 2 are formed by a two-part assembly comprising a metal handling ring 216 coupled with the first inner conductor 114 and another metal handing ring 218 coupled with the outer conductor 116. The metal handling rings 216, 218 may be coupled to the respective conductors using various methods such as press-fitting, snap-fitting, or any other appropriate coupling means. The metal handling rings 216, 218 may be made from a conductive metallic material, such as copper or copper alloy. In some examples, the metal handling rings 216, 218 may be stacked within the first and second spring grooves 180, 200 in order to house multiple canted coil spring contacts. However, the formation of the first and second spring grooves is not limited to a two-part assembly and is opened to other methods of making spring grooves.

Figure 4:
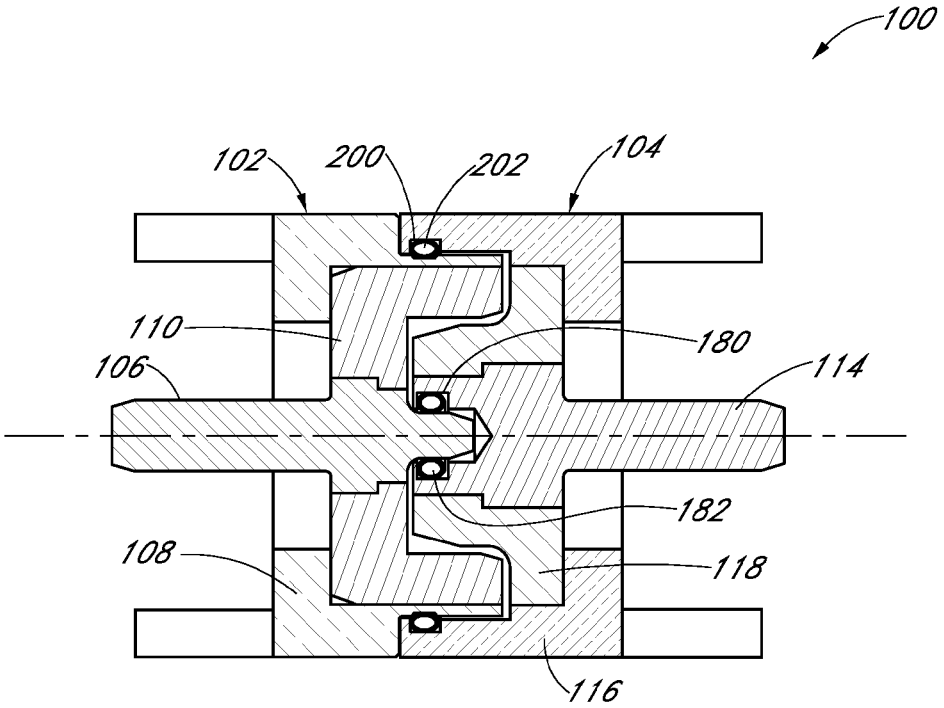
FIG. 4 shows an alternative connecting apparatus, such as a connector, comprising two connector elements that are engaged.

FIG. 4 is a cross-sectional side view of a high frequency connecting apparatus or coaxial connector 100 similar to the connector of FIGS. 1 and 2 except the first and second spring grooves or inside and outside spring grooves 180, 200 are machined grooves in metal housings. Thus, FIG. 4 shows a connecting apparatus 100 comprising two connector elements 102, 104 engaged to one another without the metal handling rings forming part of the spring grooves 180, 200.

Figure 3A:
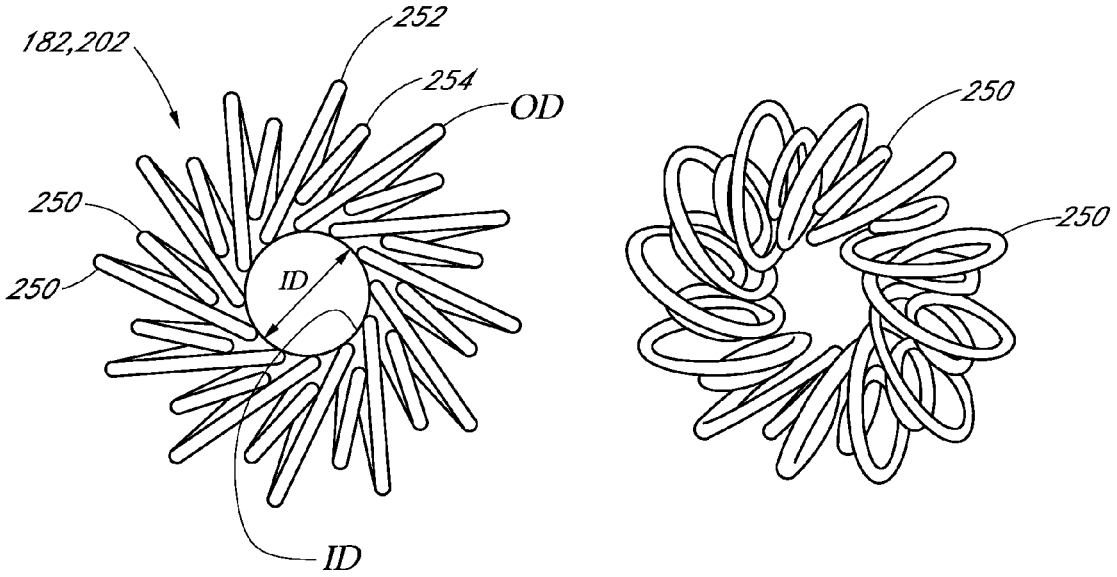
FIG. 3A shows a miniature canted coil spring contact with alternating coils with different dimensions in an uncompressed state, in end and perspective views.

FIG. 3A shows a miniature canted coil spring in an end and perspective view. The canted coil spring can be one of the canted coil springs or spring contacts 182, 202 of FIGS. 1 and 2. The canted coil spring 182, 202 comprises a plurality of coils 250 all canted generally along the same direction unlike typical helical coil springs. The plurality of coils 250 have alternating outside dimensions 252, 254 of different values or sizes. That is, the present canted coil springs have spring coils 252 of a first dimension and spring coils 254 of a second dimension, which is smaller than the first dimension. For purposes of the following discussion, the different coils may be referred to as large coils 252 and small coils 254, or alternatively as first coils 252 and second coils 254. The use of springs with different coil dimensions allows the miniature canted coil spring contact to have a reduced inner diameter ID after compression, where such reduced inner diameter ID ensures physical/electrical contact with the two connector elements, more specifically between the two outer conductors 108, 116, while preventing butting of spring coils.

To elaborate, by providing alternating coils between relatively larger coil sizes and relatively smaller coil sizes, the inside diameter ID of the canted coil spring 108, 116 is bounded or defined by fewer than all of the plurality of coils of the canted coil spring. Thus, when the canted coil spring 108, 116 is compressed, there are fewer coils occupying the inside diameter ID, which allows the canted coil spring to compress to a reduced inside diameter that is smaller in size than a comparable canted coil spring in which more coils occupy the inside diameter.

In an alternative examples, the two types of coils 252, 254 have the same outside dimension but different inside dimensions so that fewer than all of the coils occupy the inside diameter but all can occupy the outside diameter OD. The canted coil spring is configured to be compressed along both of its ID and OD to cause the plurality of coils 250 to each cant from a first position in which the coils are slanted at a respective first angle to a second position in which the coils slanted or canted to a respective second angle, which is smaller than the first angle. In some examples, the inside canted coil spring used with the inside conductor can embody a canted coil spring in which the plurality of coils have at least two different coil dimensions and wherein not all of the coils occupy the inside diameter while the outside canted coil spring used with the outer conductor can embody a standard canted coil spring in which the plurality of coils have generally the same coil dimension.

In an example, the canted coil spring with alternating coil dimensions can have more than two different coil dimensions. In other words, the plurality of coils can have at least three different coil sizes with three different coil dimensions. The different coil dimensions are arranged such that not all of the coils occupy the inside diameter. In some examples, the coils can alternate with different coil patterns. For example, if different coils having different coil major axis and minor axis can have different dimensions labeled as C1, C2, C3, etc., the coils can have the following exemplary patterns: (1) C1, C2, C1, C2, etc.; (2) C1, C2, C2, C1, C2, C2, etc.; (3) C1, C2, C3, C1, C2, C3, etc.; (4) C1, C1, C2, C1, C1, C2, etc.; (5) C1, C2, C3, C3, C1, C2, C3, C3, etc.; and (6) C1, C1, C2, C2, C1, C1, C2, C2, etc. In the foregoing examples, not all of the coils occupy the inside diameter of the spring so that the spring can compress to a relatively smaller inside diameter than a comparable canted coil spring in which all of the same number of coils occupy the inside diameter.

Figure 3B:
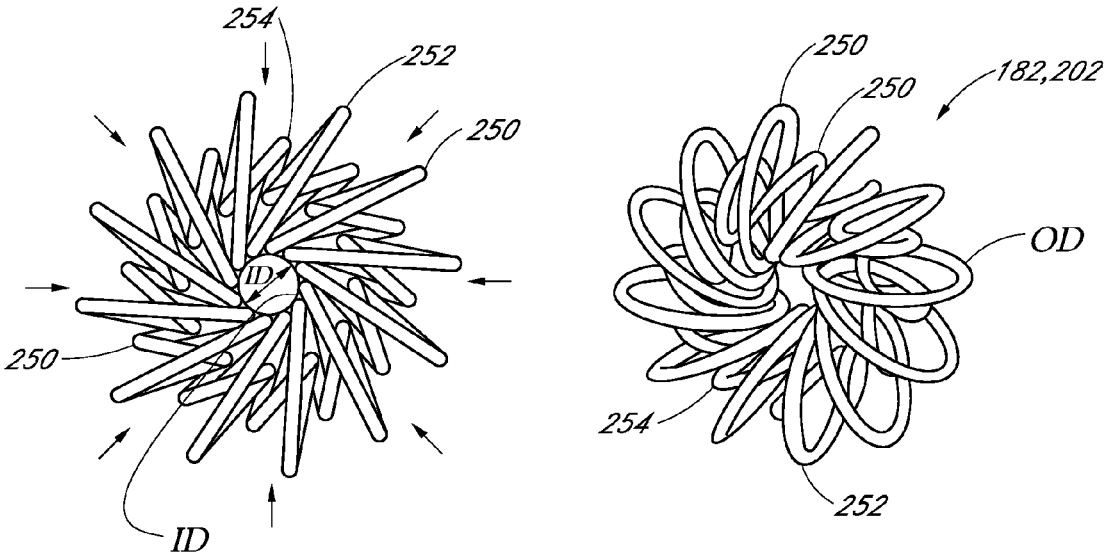
FIG. 3B shows a miniature canted coil spring contact with alternating coils with different dimensions in a compressed state, in end and perspective views.

FIG. 3B shows a miniature canted coil spring contact 182, 202 with alternating coils 250 with different dimensions 252, 254 in a compressed state, in an end and perspective views. The alternative coils 250 with different dimensions allow the spring to compress to a reduced inside diameter that is smaller in size than a comparable canted coil spring in which more coils occupy the inside diameter. As shown, fewer than all of the coils occupy the inside diameter ID in the compressed state.

Methods of manufacturing and of using the connector assemblies described herein are within the scope of the present disclosure.

Although limited embodiments of the connector assemblies and their components have been specifically described and illustrated herein, many modifications and variations will be apparent to those skilled in the art. Accordingly, it is to be understood that the connector assemblies and their components constructed according to principles of the disclosed devices, systems, and methods may be embodied other than as specifically described herein. The disclosure is also defined in the following claims.

What is claimed is:

1. A high frequency connecting apparatus comprising:

a first connector element comprising an inner conductor, an outer conductor and an insulator separating the inner conductor from the outer conductor; said insulator fitted radially in between the inner conductor and the outer conductor, wherein said inner conductor comprises a male tip;

a second connector element comprising an inner conductor, an outer conductor, and an insulator separating the inner conductor from the outer conductor, said insulator fitted radially in between the inner conductor and the outer conductor, wherein the inner conductor comprises a female tip comprising a bore for receiving the male tip;

a groove on the outer conductor of the first connector element and a groove on the outer conductor of the second connector element capturing a canted coil spring contact therebetween to provide simultaneous EMI shielding and engagement structure to engage the first connector element to the second connector element; and wherein the female tip comprises a slotted socket or a groove holding a spring contact.

2. The high frequency connecting apparatus of claim 1, wherein the male tip comprises a tapered end and the inner conductor comprises a flange.

3. The high frequency connecting apparatus of claim 1, wherein the canted coil spring contact is mounted to the groove of the outer conductor of the second connector element prior to engaging the first connector element to the second connector element.

4. The high frequency connecting apparatus of claim 3, wherein the engagement with the canted coil spring contact is a latching connection or a locking connection.

5. The high frequency connecting apparatus of claim 3, wherein the canted coil spring contact is retained to the groove by a metal handling ring.

6. The high frequency connecting apparatus of claim 1, wherein the spring contact of the female tip is a canted coil spring contact.

7. The high frequency connecting apparatus of claim 6, wherein at least one of the canted coil spring contacts has a configuration with alternating coils with different dimensions.

8. The high frequency connecting apparatus of claim 6, wherein at least one of the canted coil spring contacts is retained within at least one metal spring handling ring.

9. The high frequency connecting apparatus of claim 8, wherein the at least one metal spring handling ring is made from a copper alloy.

10. A method of manufacturing a high frequency connecting apparatus comprising:

forming a first connector element, said first connector element comprising an inner conductor, an outer conductor and an insulator separating the inner conductor from the outer conductor; said outer conductor comprising a base and an annular side extending from the base; said insulator fitted radially in between the inner conductor and the outer conductor, wherein said inner conductor comprises a male tip;

forming a second connector element, said second connector element comprising an inner conductor, an outer conductor, and an insulator separating the inner conductor from the outer conductor, said insulator fitted radially in between the inner conductor and the outer conductor, wherein the inner conductor comprises a female tip comprising a bore for receiving the male tip;

forming a groove on the outer conductor of the first connector element and a groove on the outer conductor of the second connector element;

placing a canted coil spring contact in one of the two grooves to provide simultaneous EMI shielding and engagement structure to engage the first connector element to the second connector element when engaging the two connector elements;

wherein said insulator of the first connector element comprises an insulator base and an insulator wall extending from the insulator base and along the annular side of the outer conductor of the first connector element to define a cavity for receiving the female tip; and wherein the female tip comprises a slotted socket or a groove with a canted coil spring contact.

11. The method of claim 10, wherein the canted coil spring contact is mounted to the groove of the outer conductor of the second connector element prior to engaging the first connector element to the second connector element.

12. The method of claim 10, engaging the first connector element to the second connector element and wherein the engagement is a latching connection or a locking connection.

13. The method of claim 10, wherein at least one of the canted coil spring contacts has a configuration with alternating coils with different dimensions.

14. The method of claim 13, wherein at least one of the canted coil spring contacts is retained within at least one metal spring handling ring.

15. A high frequency connecting apparatus comprising:

a first connector element comprising an inner conductor, an outer conductor and an insulator separating the inner conductor from the outer conductor; said insulator fitted radially in between the inner conductor and the outer conductor, wherein said inner conductor comprises a male tip;

a second connector element comprising an inner conductor, an outer conductor, and an insulator separating the inner conductor from the outer conductor, said insulator fitted radially in between the inner conductor and the outer conductor, wherein the inner conductor comprises a female tip comprising a bore for receiving the male tip;

a groove on the outer conductor of the first connector element and a groove on the outer conductor of the second connector element capturing a first spring contact therebetween to provide simultaneous EMI shielding and engagement structure to engage the first connector element to the second connector element; and wherein a second spring contact is located between and in contact with the female tip and the male tip.

16. The high frequency connecting apparatus of claim 15, wherein the male tip comprises a tapered end and the inner conductor comprises a flange.

17. The high frequency connecting apparatus of claim 15, wherein the female tip comprises a groove having the second spring contact received in said groove.

18. The high frequency connecting apparatus of claim 15, wherein the first spring contact is a canted coil spring contact mounted to the groove of the outer conductor of the second connector element prior to engaging the first connector element to the second connector element.

19. The high frequency connecting apparatus of claim 18, wherein the engagement with the first spring contact is a latching connection or a locking connection.

* * * * *